US005738559A

United States Patent [19]

Ostrar

[11] Patent Number: 5,738,559

[45] Date of Patent: Apr. 14, 1998

[54] PERSONALIZED NEEDLELESS PUPPET BLANK KIT

[76] Inventor: Leah Beth Levin Ostrar, 8041 N. Kedvale, Skokie, Ill. 60076-3227

[21] Appl. No.: 701,765

[22] Filed: Aug. 26, 1996

[51] Int. Cl.[6] ..... A63H 3/14

[52] U.S. Cl. ..... 446/100; 434/95; 446/327

[58] Field of Search ..... 446/85, 97, 98, 446/99, 100, 101, 327, 337; 434/81, 84, 85, 95, 260

[56] References Cited

U.S. PATENT DOCUMENTS

| | | | |
|---|---|---|---|
| 1,850,115 | 3/1932 | McCarthy | 434/95 |
| 2,585,946 | 2/1952 | Liberman | 434/95 |
| 3,581,353 | 6/1971 | Sonntag | 24/143 |
| 3,783,553 | 1/1974 | Goozner | 434/85 X |
| 4,010,570 | 3/1977 | Kohler | 446/327 |
| 4,808,139 | 2/1989 | Price | 446/327 X |

*Primary Examiner*—William H. Grieb
*Attorney, Agent, or Firm*—Kajane McManus

[57] ABSTRACT

The personalized needleless puppet kit includes at least two puppet blanks which are joined together using a yarn lace having a collared lead end for ease in threading of the lace through cooperating holes in the blanks, without requiring use of a needle. The blanks may then be decorated, as desired to produce a one or two character hand puppet, the blanks including generic ear portions which are trimmable to enhance features of the character(s) chosen for the puppet.

9 Claims, 2 Drawing Sheets

FIG. 1
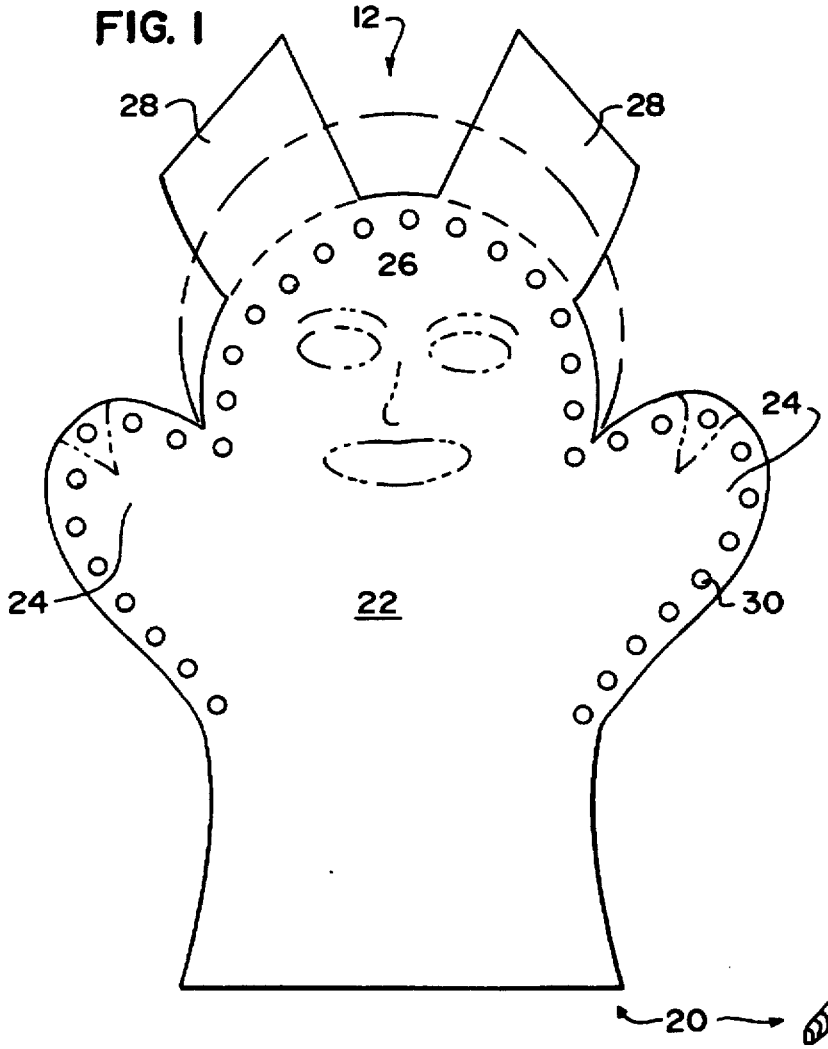
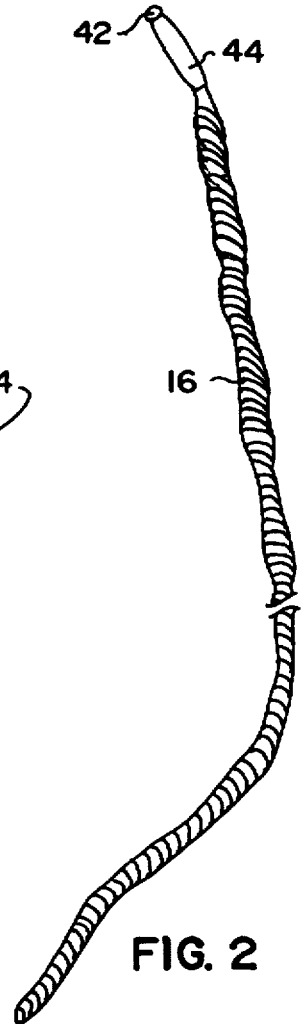
FIG. 2
FIG. 3
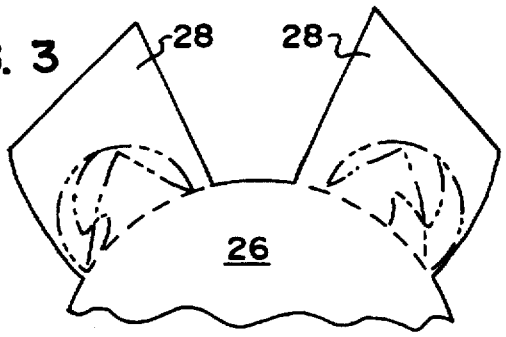
FIG. 4
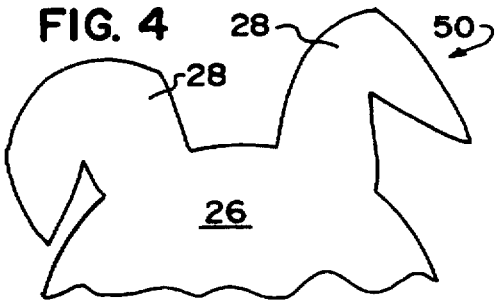
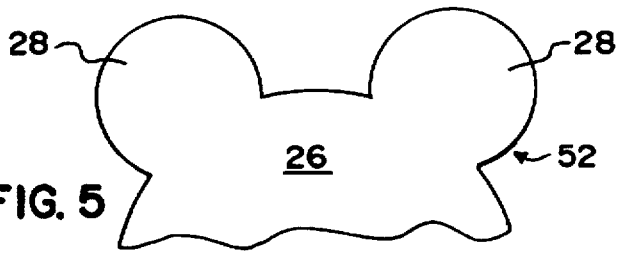
FIG. 5

PERSONALIZED NEEDLELESS PUPPET BLANK KIT

BACKGROUND OF THE INVENTION

1. Field of the invention

The present invention relates to a kit for producing a personalized puppet without requiring use of a needle.

More specifically, the kit includes a puppet-forming two piece blank, the pieces of which may be engaged to one another to produce a pocket therebetween for receiving a hand therein for manipulation of the puppet, the engagement being produced by use of a lace having a collared leading end which is weavable through holes in the blanks, the puppet blank having generic features which may be modified to produce a one sided or two sided puppet of character choice by an user, such as a small child.

2. Prior Art

Heretofore, the creation of a puppet from blanks has typically required the use of a needle for threading a lace through pieces of the blank. Such requirement has precluded involvement in this step by children too young to use a sharp instrument but old enough to know how to lace things together. Such involvement is now allowed, providing a further 'lacing' lesson for a child.

SUMMARY OF THE INVENTION

Accordingly, it is a primary object of the invention to provide a kit for creating a personalized puppet which does not require use of a needle.

Still further, it is an object to provide a puppet blank from which one, or two back-to-back, personalized puppet characters may be created.

These as well as other objects are met by the kit of the present invention which provides a two piece blank, the pieces having holes therein through which a yarn lace may be threaded to join the pieces together, the leading end of the yarn lace being adapted to feed through the holes without use of a needle and the blank pieces having a generic configuration which can be modified as desired to create a chosen configuration, and which may be further decorated to produce a one or two character personalized puppet.

BRIEF DESCRIPTION OF THE DRAWINGS

FIG. 1 is a plan view of one of the two identical puppet blank pieces of the kit.

FIG. 2 is a perspective view of a yarn lace of the kit showing the leading end as configured for needleless threadability.

FIG. 3 shows an ear portion of a blank with a plurality of possible cut configurations shown thereon in phantom.

FIGS. 4–5 show two examples of such cut out ear configurations.

DESCRIPTION OF THE PREFERRED EMBODIMENT

Figure 6:
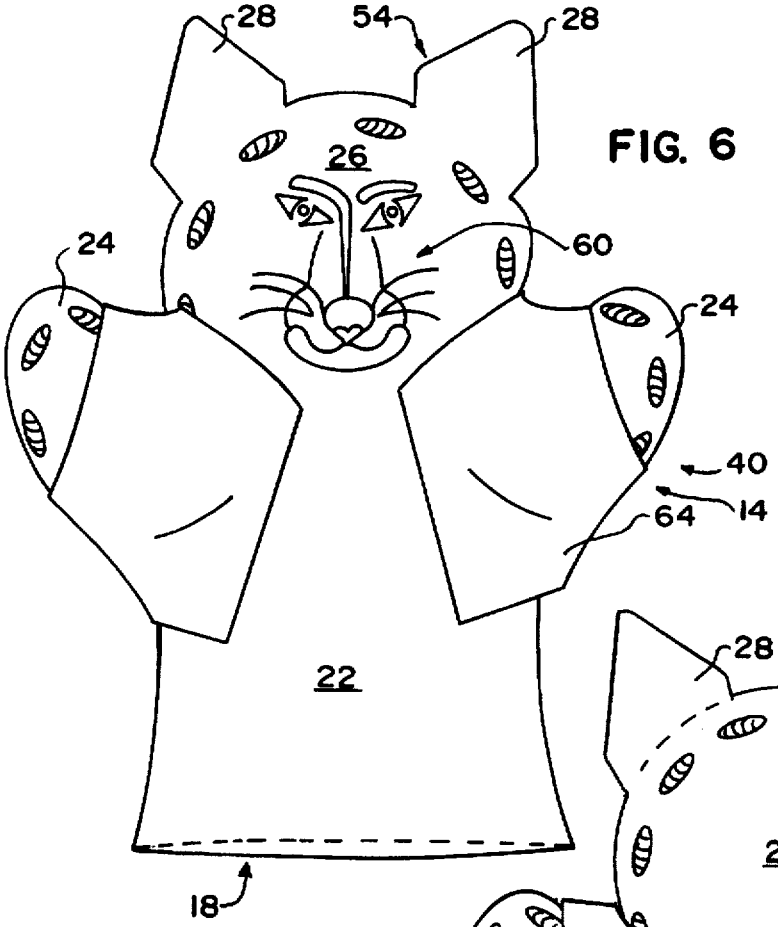
FIG. 6 shows a front view of a one character personalized puppet.

Referring now to the drawings in greater detail, there is illustrated in FIGS. 1 and 2 a blank 12 for a hand puppet (FIGS. 6–7) 14 and a threadable lace 16 which is used to join two identical blanks 12 together to create a pocket 18 (FIG. 6) therebetween within which a hand (not shown) is received. The two blanks 12 and lace 16, when provided together, produce a basic kit 20 for producing the hand puppet 14 without requiring use of a needle.

FIG. 1 shows one of two identical blanks 12 of the kit 20. As shown, the blank 12 has a body portion 22 having two oppositely directed arm portions 24 extending therefrom and has a head portion 26, extending outwardly from which are two generic ear portions 28, extending along most of a periphery of the body portion 22 and continuing around the entire periphery of the head portion 26 is a line of holes 30, the holes 30 being sized to easily receive the yarn lace 16 threadedly therein.

Figure 7:
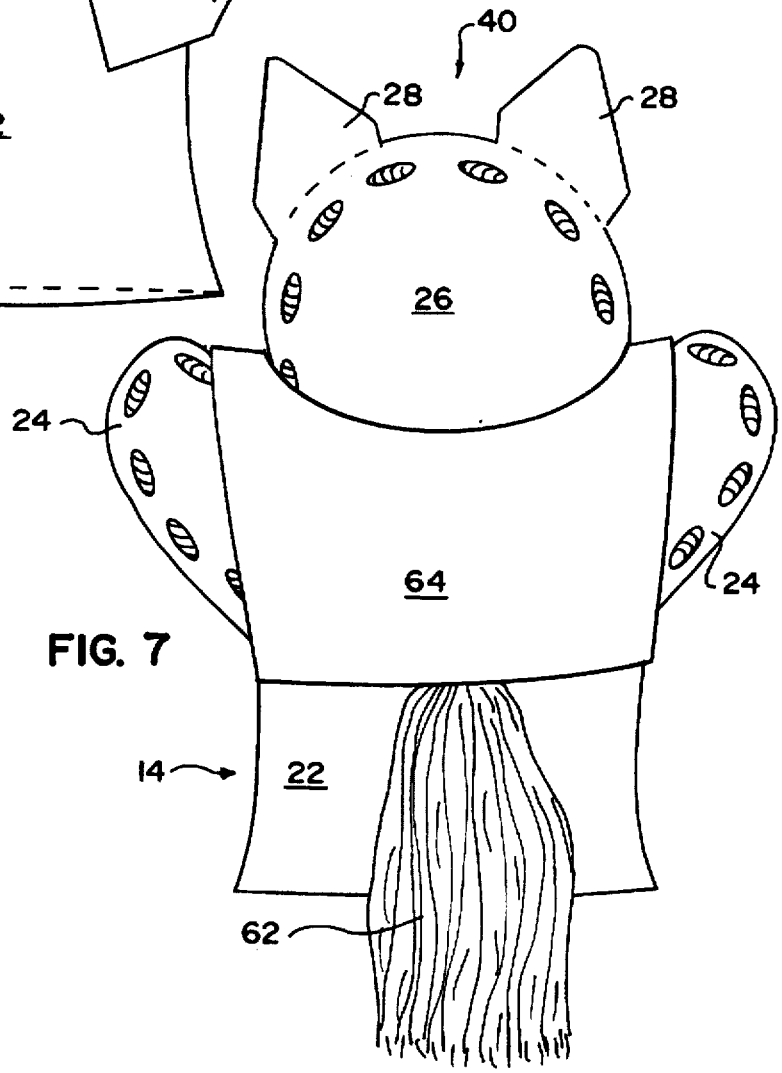
FIG. 7 shows a rear view of the one character puppet of FIG. 6.

When two such blanks 12 are placed adjacent one another, the holes 30 in each blank 12 align, allowing for easy threading of the lace 16 therethrough, to create the hand puppet 14, a one character embodiment 40 of which is shown in FIGS. 6–7.

To make lacing easy, without requiring use of a sharp instrument, a leading end 42 of the lace 16 is provided with a shrink on collar 44. The collar 44 is made of a firm yet flexible material which provides for ease in threading of the leading end 42 of the lace 16 through the holes 30.

It will be understood that the blanks 12 are made of a trimmable material, such as felt, which may be cut with scissors to produce a desired configuration for each blank 12, as will be described below.

For example, once the blanks 12 are threaded together substantially as shown in FIGS. 6–7, the user may choose one of a plurality of available configurations, shown in FIGS. 3–5, for the ears of the character chosen to be depicted.

FIG. 3 shows in phantom a plurality of available ear configurations, large or small, that are offered by providing a blank ear portion 28 substantially as shown. More particularly, a rabbit ear configuration 50 is shown in FIG. 4, a mouse ear configuration 52 is shown in FIG. 5, and, obviously, a wolf ear configuration 54 is shown in FIGS. 6 and 7.

It will be understood that such trimmability also extends to the arm portions 24 and the body and head portions, 22 and 26, respectively, as well; i.e., if desired, the ear portions 28 could be cut away to create a human character, as shown in phantom in FIG. 1.

With further reference to FIGS. 6 and 7, it will be seen first of all that a face 60 may be created for the puppet 14. This can be accomplished in a variety of ways. One way is illustrated, with the face being drawn or stenciled (FIG. 6) onto the head portion 26 of one blank 12. Alternatively, features could be provided and/or attached by means of Velcro™ type fasteners or double sided adhesive material. Also, further features, such as a tail 62 illustrated and a vest 64 shown, could be provided for attachment, for further enhancement of character features for a one character puppet 14.

Still further, as illustrated in phantom in FIG. 1 and when taken in combination of with blank 12 of FIG. 6, a two character puppet 14 is produced with one blank 12 (FIG. 1) representing a frontal view of one character, such as a person, and the second blank 12 (FIG. 6) representing a frontal view of another character, so that merely turning the puppet 14 from one side to another could produce two interactive characters for visualization, i.e., Peter and the Wolf, the Hare and the Tortoise, Cinderella in her tatters and Cinderella ready for the ball, etc.

As described above, the puppet kit 20 of the present invention provides a number of advantages, some of which have been described above and others of which are inherent in the invention. Also, modifications may be proposed to the kit 20 without departing from the teachings herein. Accordingly, the scope of the invention is only to be limited as necessitated by the accompanying claims.

I claim:

1. A personalized needleless hand puppet kit for creating a hand puppet defining at least one desired character, the kit comprising:

at least two generic puppet blanks, each including a head portion, a body portion, two arm portions extending from the body portion, two ear portions extending from the head portion, the body portion and head portion having a continuous periphery along which a line of holes is provided wherein at least the ear portions are trimmable for enhancing character features: and a lace made of yarn, the lace having a leading end, and a collar of heat shrink material being engaged about the leading end for ease in threading the lace through the line of holes in the blanks when placed to overlie each other identically for lacing the blanks together to create a hand engaging pocket therebetween, without requiring use of a threading needle.

2. The kit of claim 1 wherein said blanks are capable of being decorated.

3. The kit of claim 2 wherein said blanks are made of a material upon which features for the puppet may be drawn.

4. The kit of claim 1 wherein said blanks are made of a material upon which feature creating structures for the puppet may be glued.

5. The kit of claim 1 wherein said blanks are made of a material upon which feature creating structures for the puppet may be attached by means of Velcro™ fasteners.

6. The kit of claim 5 wherein said feature creating structures are provided in the kit.

7. The kit of claim 6 wherein said structures are made of adhesive backed material.

8. The kit of claim 1 wherein a two sided one character is produced.

9. The kit of claim 1 wherein a two sided, two character puppet is produced.

* * * * *